US009484700B2

(12) United States Patent
Kehoe

(10) Patent No.: US 9,484,700 B2
(45) Date of Patent: Nov. 1, 2016

(54) HYDRAULIC POWER TOOL

(71) Applicant: MILWAUKEE ELECTRIC TOOL CORPORATION, Brookfield, WI (US)

(72) Inventor: Sean T. Kehoe, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 14/873,352

(22) Filed: Oct. 2, 2015

(65) Prior Publication Data

US 2016/0099533 A1 Apr. 7, 2016

Related U.S. Application Data

(60) Provisional application No. 62/060,170, filed on Oct. 6, 2014.

(51) Int. Cl.

| | |
|---|---|
| ***B21D 37/10*** | (2006.01) |
| ***H01R 43/042*** | (2006.01) |
| ***B25B 27/10*** | (2006.01) |

(52) U.S. Cl.

CPC ..... *H01R 43/0427* (2013.01); *B21D 37/10* (2013.01); *B25B 27/10* (2013.01)

(58) Field of Classification Search

CPC ..... H01R 43/0427; B25B 27/10
USPC ..... 72/452.8, 453.16, 416
See application file for complete search history.

(56) References Cited

U.S. PATENT DOCUMENTS

| | | | |
|---|---|---|---|
| 4,521,963 | A | 6/1985 | Lind et al. |
| 5,111,681 | A | 5/1992 | Yasui et al. |
| D356,478 | S | 3/1995 | Heskey et al. |
| 5,611,228 | A | 3/1997 | Dummermuth |
| 5,671,961 | A | 9/1997 | Buck |
| D408,242 | S | 4/1999 | Yamamoto |
| 5,934,136 | A | 8/1999 | Bracher et al. |
| 6,044,681 | A | 4/2000 | Frenken |
| 6,085,422 | A | 7/2000 | Hirabayashi |
| 6,230,542 | B1 | 5/2001 | Frenken |
| 6,244,085 | B1 | 6/2001 | Dummermuth |
| 6,434,998 | B2 | 8/2002 | Amherd |
| 6,446,482 | B1 | 9/2002 | Heskey et al. |
| 6,532,790 | B2 | 3/2003 | Frenken |
| 6,619,101 | B1 | 9/2003 | Faucher et al. |
| 6,666,064 | B2 | 12/2003 | LeFavour et al. |

(Continued)

OTHER PUBLICATIONS

International Search Report issued in connection with Co-Pending International Application No. PCT/US2015/053694, Korean Intellectual Propert Office, dated Jan. 7, 2016, 5 pages.

(Continued)

*Primary Examiner* — David B Jones
(74) *Attorney, Agent, or Firm* — McDonnell Boehnen Hulbert & Berghoff LLP

(57) ABSTRACT

A biased closed crimping head for a hydraulic power tool. The crimping head comprises a first pivoting pin and a first jaw disposed for rotation about a first axis defined by the first pivoting pin. The crimping head further comprises a second pivoting pin and a second jaw disposed for rotation about a second axis defined by the second pivoting pin. An extension spring is operatively coupled to the first jaw and the second jaw so that the jaws reside in a biased closed position. During a crimping action, the first jaw rotates about a first axis defined by the first pivoting pin, and the second jaw rotates about a second axis defined by the second pivoting pin.

20 Claims, 13 Drawing Sheets

(56) References Cited

U.S. PATENT DOCUMENTS

| | | | |
|---|---|---|---|
| 6,668,613 | B2 | 12/2003 | Lefavour et al. |
| 6,718,870 | B1 | 4/2004 | Frenken |
| 6,739,172 | B2 | 5/2004 | Wagner |
| 6,792,789 | B1 | 9/2004 | Faucher |
| 7,111,488 | B2 | 9/2006 | Lefavour et al. |
| 7,124,619 | B1 | 10/2006 | Lefavour et al. |
| 7,134,314 | B1 | 11/2006 | Peterson et al. |
| 7,216,523 | B2 | 5/2007 | Frenken |
| 7,254,982 | B2 | 8/2007 | Frenken |
| 7,363,799 | B2 * | 4/2008 | Hamm ..... B25B 25/005 72/452.8 |
| 7,412,868 | B2 | 8/2008 | Frenken |
| 7,421,877 | B2 | 9/2008 | Frenken |
| 7,434,441 | B2 | 10/2008 | Frenken |
| 7,634,859 | B2 | 12/2009 | Amherd |
| 7,665,343 | B2 | 2/2010 | Ballas et al. |
| 7,762,117 | B2 | 7/2010 | Faucher et al. |
| 7,788,779 | B2 | 9/2010 | Frenken |
| 7,882,722 | B2 | 2/2011 | Lefavour et al. |
| 7,908,741 | B2 | 3/2011 | Chawgo |
| 7,908,963 | B2 | 3/2011 | Frenken |
| 8,056,473 | B2 | 11/2011 | Frenken |
| 8,074,485 | B2 | 12/2011 | College |
| 8,151,703 | B2 | 4/2012 | Schweizer et al. |
| 8,245,561 | B2 | 8/2012 | Frenken |
| 8,276,430 | B2 | 10/2012 | Barezzani et al. |
| 8,316,685 | B2 | 11/2012 | Stucki et al. |
| D673,829 | S | 1/2013 | Takeshima et al. |
| 8,418,520 | B2 | 4/2013 | Stucki et al. |
| D690,177 | S | 9/2013 | Frenken |
| D696,090 | S | 12/2013 | Takeshima et al. |
| 8,656,574 | B2 | 2/2014 | Frenken |
| 8,671,579 | B2 | 3/2014 | Frenken |
| D709,748 | S | 7/2014 | Frenken |
| D710,173 | S | 8/2014 | Frenken |
| 8,839,653 | B2 | 9/2014 | Roman, Jr. et al. |
| 8,844,436 | B2 | 9/2014 | Frenken |
| 8,919,176 | B2 | 12/2014 | Barezzani et al. |
| 8,935,948 | B1 | 1/2015 | Gregory |
| 8,997,543 | B2 | 4/2015 | Therrien |
| 9,016,103 | B2 | 4/2015 | Frenken |
| 2006/0000072 | A1 | 1/2006 | Frenken |
| 2006/0032285 | A1 | 2/2006 | Lefavour et al. |
| 2008/0289394 | A1 | 11/2008 | Mitchell |
| 2009/0313820 | A1 | 12/2009 | Roman, Jr. et al. |
| 2010/0236079 | A1 | 9/2010 | Bush |

OTHER PUBLICATIONS

Written Opinion issued in connection with Co-Pending International Application No. PCT/US2015/053694, Korean Intellectual Property Office, dated Jan. 7, 2016, 9 pages.

* cited by examiner

HYDRAULIC POWER TOOL

CROSS REFERENCE TO RELATED APPLICATION

The present application claim priority to U.S. Provisional patent application 62/060,170, filed on Oct. 6, 2014, and entitled "Hydraulic Power Tool," which is herein incorporated by reference as if fully set forth in this description.

FIELD

The present disclosure relates generally to power tools. More particularly, the present disclosure relates to a hand-held crimping power tool.

BACKGROUND

Hydraulic crimpers and cutters are different types of hydraulic power tools for performing work (e.g., crimping or cutting) on work piece. In such tools, a hydraulic tool comprising a hydraulic pump is utilized for pressurizing hydraulic fluid and transferring it to a cylinder in the tool. This cylinder causes an extendible piston to be displaced towards a crimping head. The piston exerts a force on the crimping head of the power tool, which may typically include opposed jaws with certain crimping features, depending upon the particular configuration of the power tool. In this case, the force exerted by the piston may be used for closing the jaws to perform crimp or compression on a work piece at a targeted crimp location.

Certain hydraulic crimping tools and associated crimping heads are known. For example, one known hydraulic crimping tool utilizes a biased open-single pivot crimping head. Such a biased open crimping tool head may be spring biased such that the jaws of the crimping tool pivot about a single pivoting point axis. Spring biased jaws remain open prior to initiation of the crimp. There are certain perceived disadvantages of utilizing such a biased open-single pivot crimping head. As just one disadvantage, because of the biased open nature of the jaws of such a crimping head, proper alignment of the crimping jaws with the crimp target is often difficult since the crimping head is biased open. Oftentimes, in an attempt to accomplish a successful crimp at a targeted connector location, a user of such a biased open crimping device may "jog" (i.e., quickly starting and stopping) the device to approach a closed jaw position just prior to the actual crimping operation in order to achieve a desired crimp location on the connector. Such a process may result in a crimp that is performed at an undesired location on the connector. In addition, such a process may also add additional time and touch labor as some connectors (especially high voltage/high current application) may utilize large aluminum to copper splicing connectors or aluminum to aluminum splicing connectors (such as on the order of over 5 inches in length) and may require repeated crimps.

In addition, oftentimes, for certain high voltage or high current crimping applications, using such a biased open crimping head may take at lease two individuals—one operating the crimping tool and one positioning the connector—in order to ensure properly aligning the crimp head jaws and a connector target location in order to achieve a proper crimp. Another perceived disadvantage of such a single pivot crimping head is that during the connector crimping process, if the crimping head is not repeatedly rotated with respect to the connector after each connector crimp, a certain amount of generally undesirable connector warpage may be experienced.

There is, therefore, a need for a hydraulic crimping tool that may be used to achieve a uniform, controllable crimp while minimizing the amount of connector warpage. There is also a need for a hydraulic crimping tool that is easier to use than certain known hydraulic crimping tools, such a single-pivot, biased open crimping tool heads. There is also a general need for a hydraulic crimping tool that can be used by a single operator and does not require two individuals to achieve a desirable connector crimp.

SUMMARY

According to an exemplary arrangement, a biased closed crimping head for a hydraulic power tool is disclosed. The crimping head comprises a first pivoting pin and a first crimping jaw disposed for rotation about a first axis defined by the first pivoting pin. The crimping head further comprises a second pivoting pin and a second crimping jaw disposed for rotation about a second axis defined by the second pivoting pin. An extension spring is operatively coupled between the first crimping jaw and the second crimping jaw so that the first and second crimping jaws reside in a biased closed position. During a crimping action, the first crimping jaw rotates about the first axis defined by the first pivoting pin, and the second crimping jaw rotates about the second axis defined by the second pivoting pin.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art.

Figure 1:
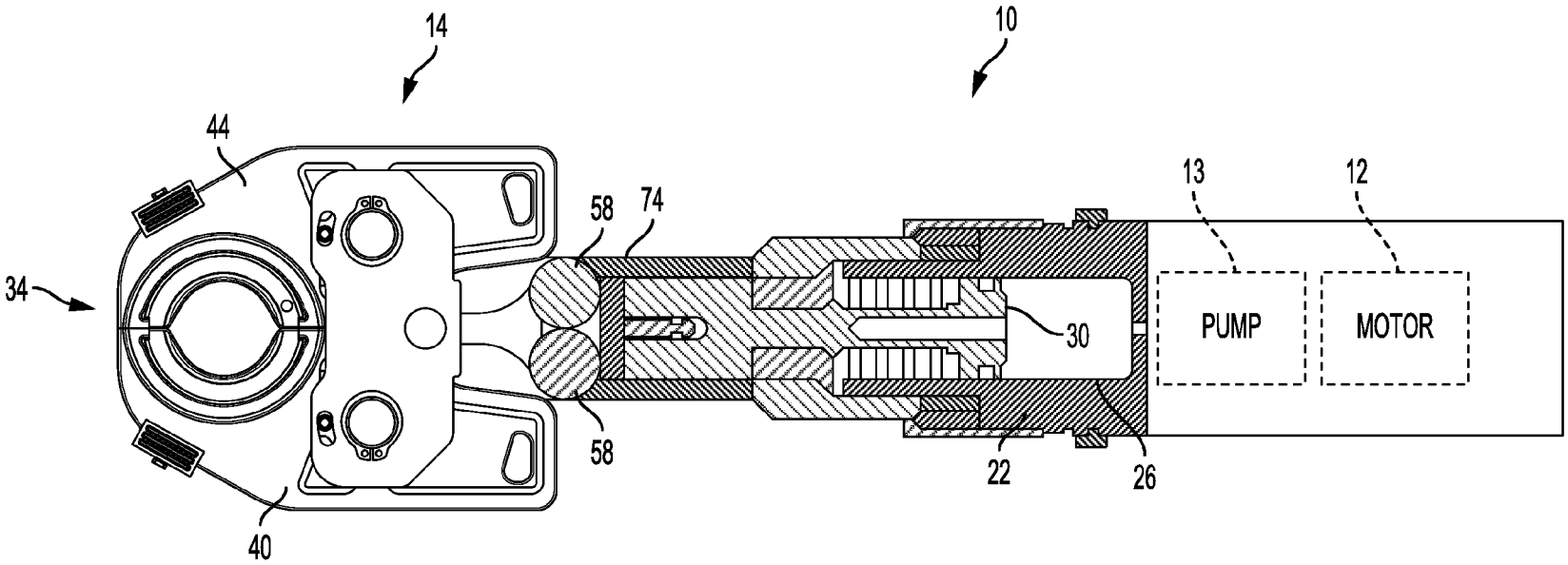
FIG. 1 illustrates a cross-sectional view of a crimping head removably mounted to a hydraulic tool of the present disclosure.

FIG. 1 illustrates a hydraulic crimper 10 comprising a biased closed, dual pivoting crimping head 14. This hydraulic crimper 10 comprises an electric motor 12, a pump 13 driven by the motor 12, and a housing 22 defining a cylinder 26 therein. An extendable piston 30 is disposed within the cylinder 26. As described in greater detail herein, the pump provides pressurized hydraulic fluid to the piston cylinder 26, causing the piston 30 to extend from the housing 22 to thereby actuate a pair of crimping jaws 34 of the crimping head 14 for crimping a work piece, such as an electrical connector. The crimping jaws 34 comprises a first crimping jaw 40 and a second crimping jaw 44.

Figure 2:
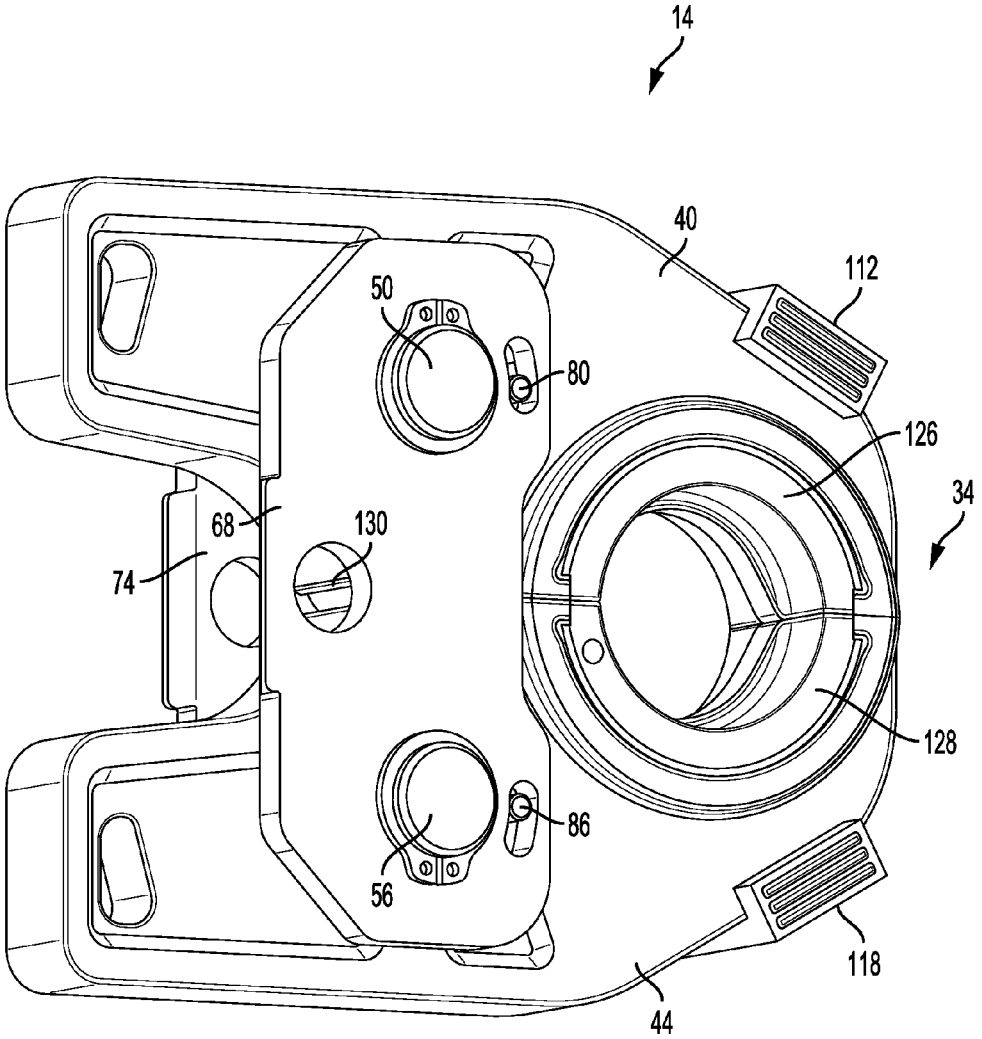
FIG. 2 illustrates a perspective view of the crimping head illustrated in FIG. 1.
Figure 3:
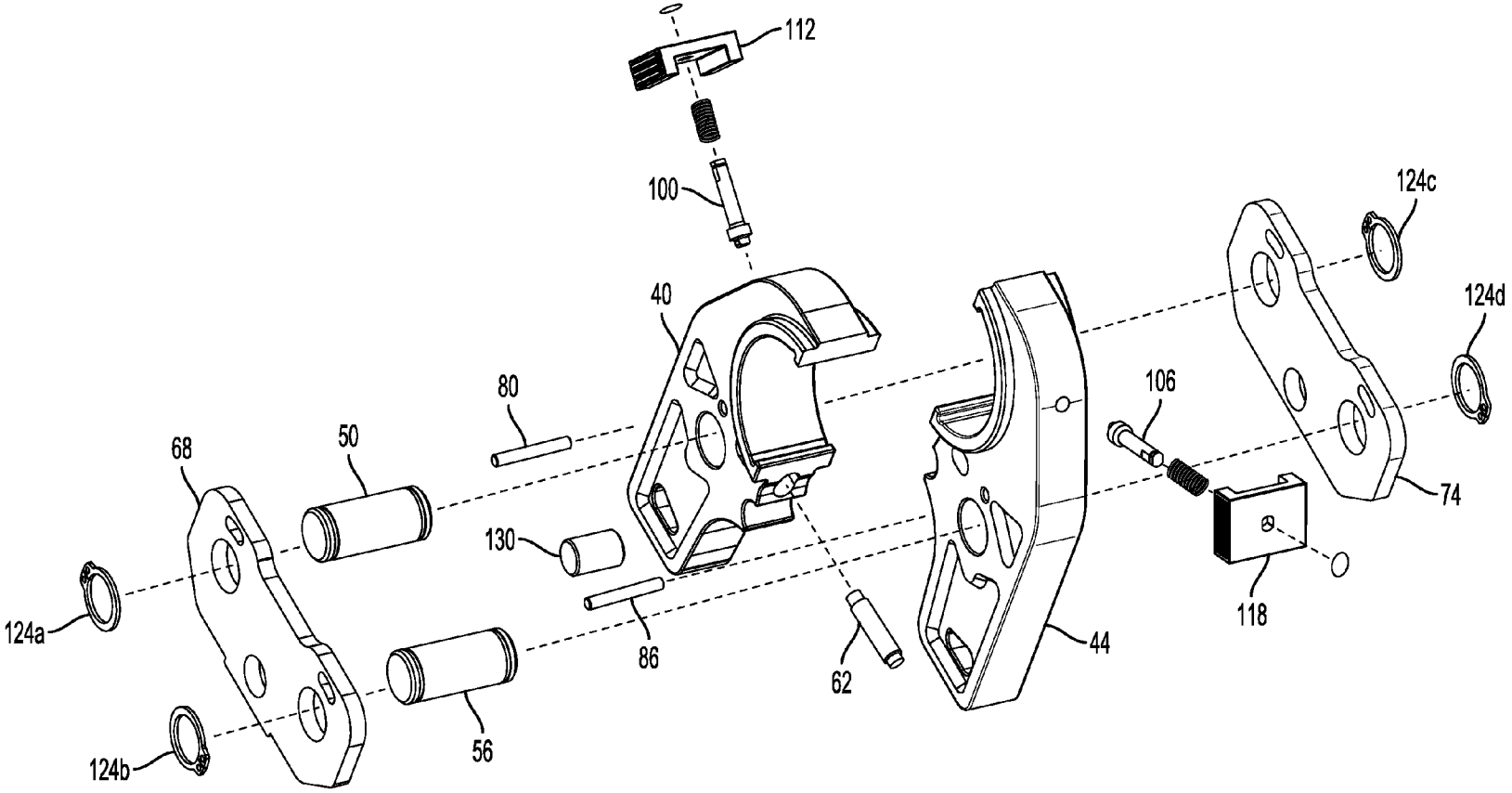
FIG. 3 illustrates an exploded view of the crimping head illustrated in FIG. 2.

FIG. 2 illustrates a perspective view of the hydraulic crimping head 14 illustrated in FIG. 1 in a biased closed or crimping position. FIG. 3 illustrates an exploded view of the various components parts making up the hydraulic crimping head 14 illustrated in FIGS. 1 and 2. With reference to FIGS. 2 and 3, the crimping head 14 comprises a pair of crimping jaws 34 comprising a first crimping jaw 40 and a second crimping jaw 44. Each jaw 40, 44 is configured to pivot about a separate and independent pivot pin. For example, the first crimping jaw 40 is configured to pivot about the first pivot pin 50 and the second crimping jaw 44 is configured to pivot about the second pivot pin 56. An extension spring 62 (FIG. 3) is retained by both the first and the second jaws 40, 44 so as to bias the first and second jaws towards one another.

Further elements of the crimping head 14 include a first and second side plates 68, 74, a first and second stop pins 80, 86, a first and second dies 126, 128, a first and second die pins 100, 106, a first and second release tabs 112, 118, a plurality of retaining pins 124*a-d*, and a dowel or translation pin 130.

Each of the crimping jaws comprise a die mount that supports a corresponding die as will be described in greater detail below. For example, the first crimping jaw 40 comprises a die mount that supports a first die 126 and the second crimping jaw 44 comprises a die mount that supports a second die 128.

Figure 4:
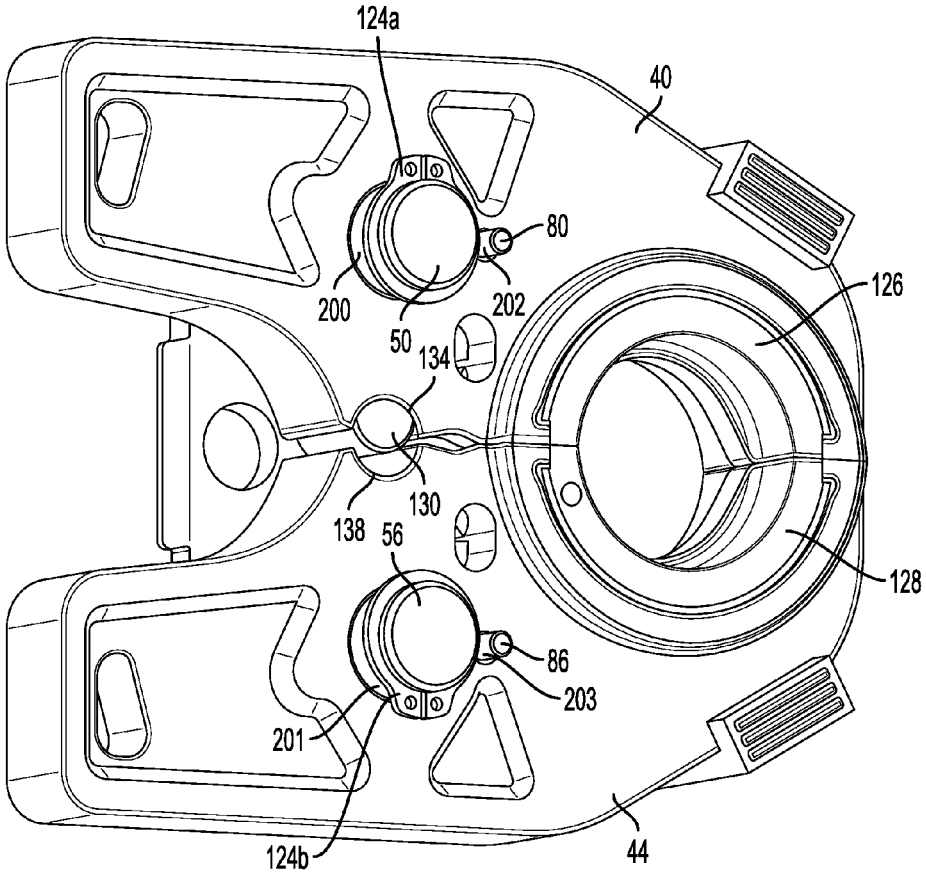
FIG. 4 illustrates a perspective view of the crimping head illustrated in FIG. 2 with one of the side plates removed.

When the crimping jaws 40, 44 are assembled together, the first and second pivot pins 50, 56 define a first and a second pivot axis for the first and second crimping jaws 34, 44. The dowel or translation pin 130 is provided between a dowel recess 134 on a contour of the first crimping jaw 40 and a dowel recess 138 on a contour of the second crimping jaw 44 as illustrated in FIG. 4. The dowel pin 130 is provided to keep the first and second crimping jaws 40, 44 synchronized while these crimping jaws pivot about their respective axis from the biased open position to the closed position (e.g., as one jaw moves, the dowel pin 130 cams against the surface of the other jaw to move the jaw synchronously with the one jaw). Another advantage of the presently disclosed dowel pin configuration is that it helps to ensure that the crimping head 14 provides for an even crimp, thereby preventing undesired connector warpage that may occur after repeated connector crimps.

The crimping head 14 further comprises first and second die pins 100, 106 and first and second release tabs 112, 118 both of which (as will be described below) are used for removably securing a respective die in a respective crimping jaw. The crimping head 14 further comprises a first and second pivoting pins 50, 56 and first and second stop pins 80, 86 for enabling the pivoting movement of the crimping jaws 40, 44. The first and second pivoting pins 50, 56 are inserted into the crimping jaws and have a length that is generally greater than a width of each jaw such that the pivot pins extend away from both the top and bottom surfaces of the jaw. The first and second side plates 68, 74 allow for the assembled jaw 34, and the various lock washers 124*a-d* are used to assemble the first and second side plates 68, 74 onto the crimping head 14.

As assembled and as illustrated in FIG. 2, the first and second crimping jaws 40, 44 are symmetrical in structure to one another and are pivotally maintained to work with one another. The crimping jaws 34 are held together by way of a first side plate 68 on a first side of the crimping head 14. Similarly, a second side plate 74 is provided on a second side of the crimping head 14. For example, FIG. 4 illustrates a perspective view of the crimping head 14 illustrated in FIG. 2 but with the first side plate removed from the first side of the crimping head for ease of explanation. As illustrated, the first pivot pin 50 resides in a first pivot pin bore 200 of the first crimping jaw 40 while the second pivot pin 56 resides in a second pivot pin bore 201 of the second crimping jaw 44. As also illustrated, a first stop pin 80 resides within a stop pin bore 202 defined by the first crimping jaw 40 and a second stop pin 86 resides within a stop pin bore 203 defined by the second crimping jaw 44.

Figure 5:
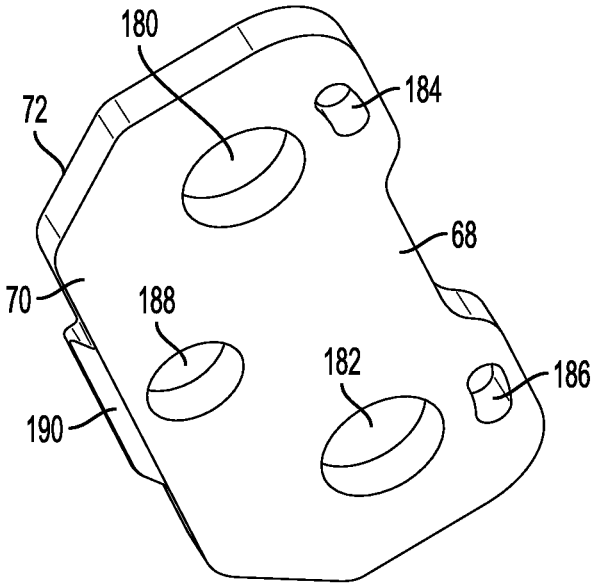
FIG. 5 illustrates a close up view of one of the side plates illustrated in FIG. 3.

FIG. 5 illustrates a perspective view of the first side plate 68 illustrated in FIGS. 1 and 2. Referring now to both FIGS. 4 and 5, the first slide plate 68 comprises two pivot pin bores 180, 182 and two stop pin bores 184, 186, all of which extend between a first surface 70 and a second surface 72 within the first side plate 68. As illustrated, the two pivot pin bores 180, 182 are circular in shape and are sized to receive the first and second pivot pins 50, 56 (see, e.g., FIG. 4), respectively.

In contrast, the two stop pin bores 184, 186 are non-circular and define a curved keyway that receives the pivoting stop pins 80, 86. As such, these curved keyways allow a certain degree of movement of the stop pins 80, 86 during the opening and closing of the crimping head jaws 34. In addition, the side plate 68 further comprises a clearance chamfer 190 provided along a side surface of the side plate. This clearance chamfer 190 is provided so as to allow for a certain degree of clearance for the roller assembly during crimping action so that the rollers can get as deep into the crimping jaws 34 as possible without contacting the first and second side plates 68, 74. See, FIGS. 8 and 10.

When assembled onto either the top surface or the bottom surfaces of the crimping jaw, the first side plate 68 will be positioned such that the first and second stop pins 80, 86 will be aligned within the first and second stop pin bores 184, 186, respectively. Similarly, the first side plate 68 is positioned such that the first and second pivot pins 50, 56 will be positioned within the first and second pivot pin bores 180, 182, respectively. Once properly positioned, the retaining pins 124 *a-d* will be used to secure the first and second side plates in position.

Figure 11:
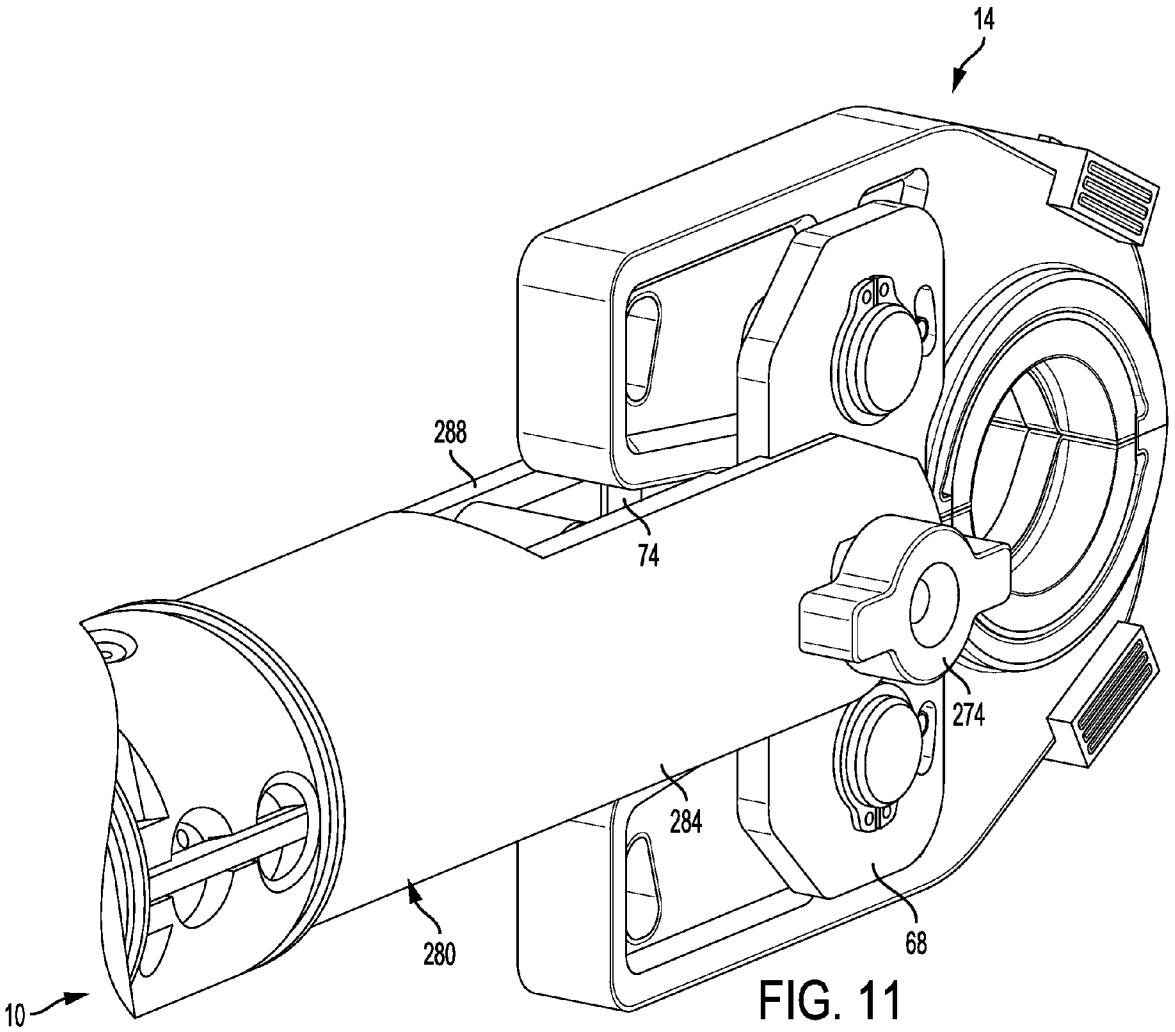
FIG. 11 illustrates a perspective view of the crimping head connected to the hydraulic tool.
Figure 12:
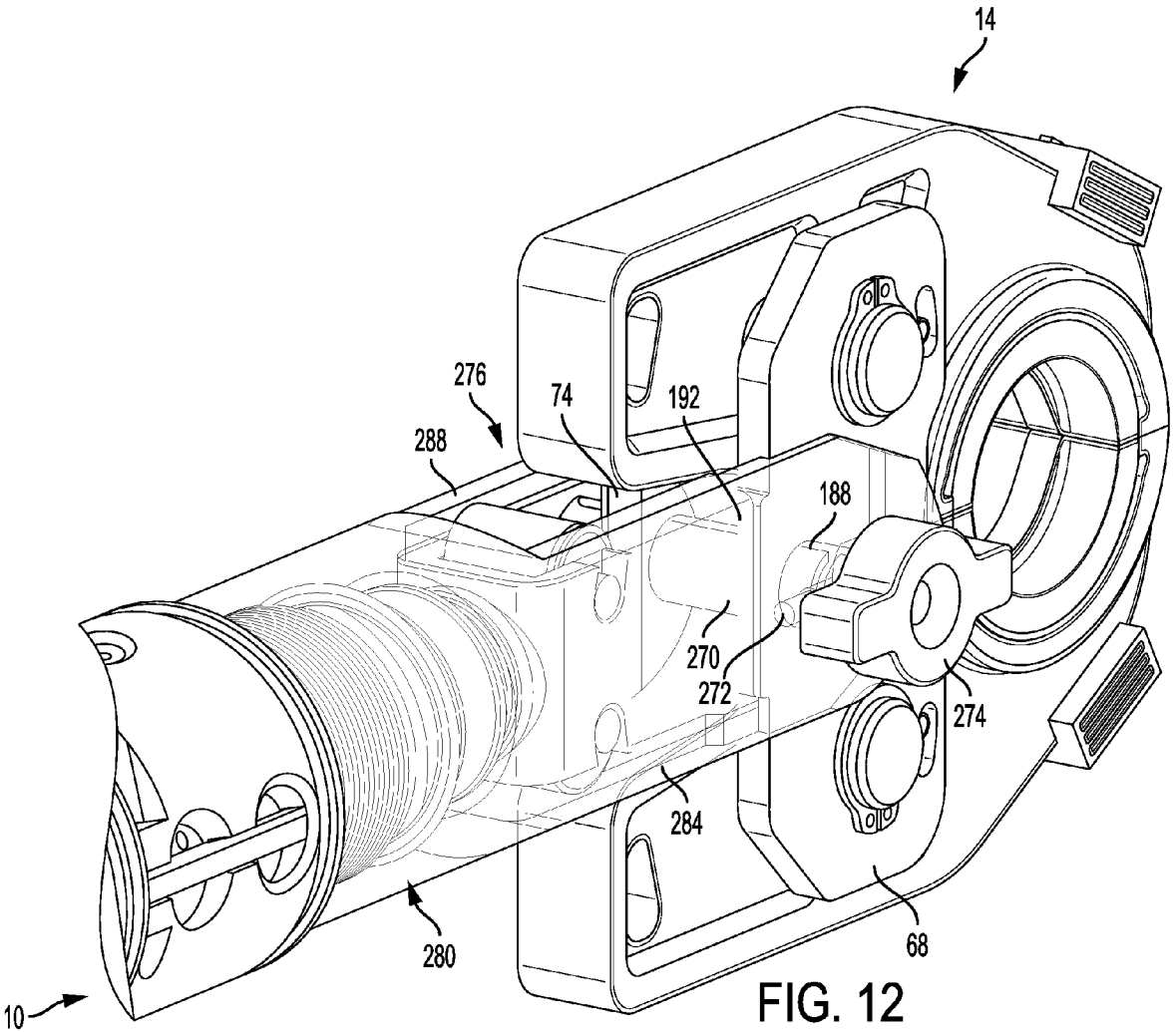
FIG. 12 illustrates a cross sectional view of the crimping head connected to the hydraulic tool.

The first side plate 68 further comprises a connecting bore 188. This connecting bore 188 is used to connect the crimping head 14 to the hydraulic tool 10 as illustrated in FIG. 1. To accomplish this connection, a connecting pin is used and is slid into each connecting bore 188, 192 of the first and second side plate 68, 74 so as allow the compression head to be mounted onto the hydraulic tool. For example, FIG. 11 illustrates a perspective view of the crimping head 14 connected to the hydraulic tool 10 and FIG. 12 illustrates a cross sectional view of the crimping head 14 connected to the hydraulic tool 10. As illustrated in FIGS. 11 and 12, a sliding pin 270 is shown and includes a first end 272 provided with a handle portion 274 to facilitate manipulation of the sliding pin 270 and a second end 276 opposite the first end 272. The handle portion 274 may be secured to the first end by a press-fit, adhesive, fusion-bond, set screw, or any other suitable arrangement. Alternatively, the handle portion 274 may be integrally formed as a single piece with the remainder of the sliding pin 270.

The sliding pin 270 is axially movable between an inserted position as illustrated in FIGS. 11 and 12 and a withdrawn position. In the inserted position, the pin 270 extends through the first and second side plate connecting bores 188, 192 and through coaxial bores in the respective first and second legs 284, 288 of the u-shaped or forked shaped clevis 280 so as to removably couple the crimping head to a clevis 280 of the power tool 10. In the withdrawn position, the sliding pin 270 will be removed from the clevis legs 284, 288 so as to allow the crimping head 14 to be removed from the clevis 280.

Figure 6:
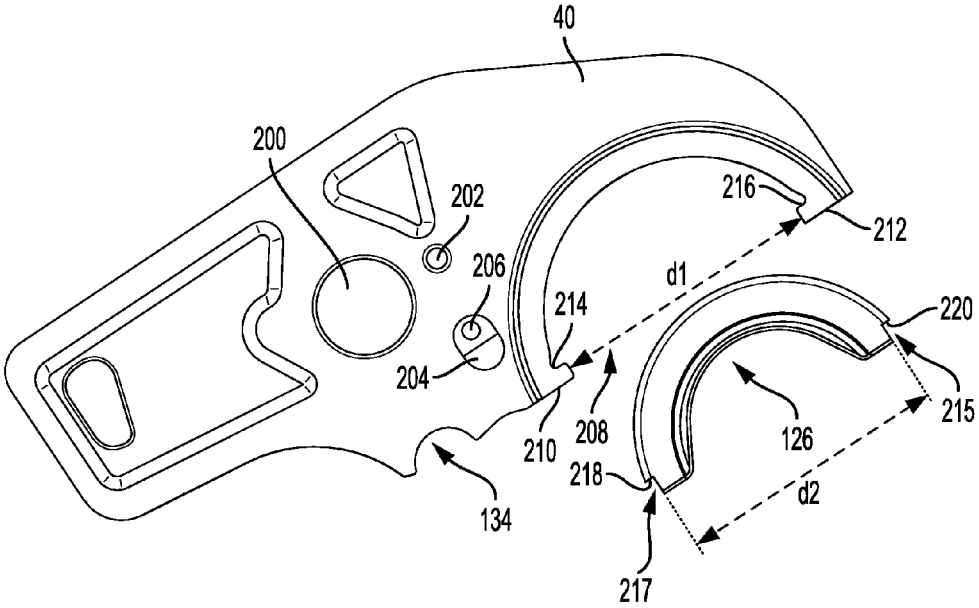
FIG. 6 illustrates a close up view of one of the jaws and corresponding die that can be used for the crimping head illustrated in FIG. 3.

FIG. 6 illustrates a close up perspective view of the first crimping jaw 40 of the crimping head 14. The second crimping jaw 44 of the crimping head 14 is configured mirror image of the first crimping jaw 40. As illustrated in FIG. 6, the first jaw 40 comprises a first bore 200 for receiving the first pivot pin 50 and a second bore 202 for receiving the first stop pin 80. The first crimping jaw 40 further comprises a location bore and assembly bore for the jaw extension spring. As previously explained, this jaw extension spring 62 retains the crimping head jaws in a normally closed biased position as illustrated in FIG. 2. The second crimping jaw 44 comprises a similar pivot pin and stop pin bore configuration.

As discussed above, the crimping head 14 comprises a first and a second die 126, 128 that are removably inserted to the first and second crimping jaws, respectively. The first and second dies 126 and 128 could be made, for example, of stainless steel. However, other materials are envisioned. Although one size die is illustrated, those of ordinary skill in the art will recognize alternative sized dies may also be used with the presently disclosed crimping head 14. FIG. 6 illustrates a close up view illustrating how the first die 126 is configured to be seated within the first crimping jaw 40. As illustrated, a portion of a contour of the first crimping jaw 40 comprises an arc or jaw mouth 208 that is generally circular in design. This jaw mouth 208 comprises a first and second edge 210, 212 that comprises a first and a second curved edge or lip portion 214, 216. This configuration allows for the die 126 to be seated within these two curved edges or lip portions 214, 216. For example, in one embodiment, the jaw mouth 208 is shaped such that the lips 214 and 216 are spaced apart a distance d1. In one example, the distance d1 is less than 40 millimeter (mm). In another example, the distance d1 is less than 39.8 mm. In another example, the distance d1 is less than 39.6 mm. Other example distances are envisioned.

As can be seen from FIG. 6, the first die 126 is generally semi-circular in nature and is provided with a first notch 218 at a first end of the semi-circular die and a second notch 220 provided at the other or second end of the semi-circular die. These two notches 218 and 220 are generally configured to allow the die to be slid into the jaw opening so that the first and the second clamping lips of the jaw mouth to prevent the die from dropping out of the jaw head. Once the die is slid into this position as illustrated in FIGS. 2 and 4, a release tab and release pin configuration may be used to further secure this die in position.

With further reference to FIG. 6, in one embodiment, the die 126 includes cutout portions 215 and 217 in its outer surface to accommodate the lips 214 and 216 when the die 126 is seated in the jaw mouth 208. The outer surfaces of the cutout portions 215 and 217 are spaced apart a distance d2. The die 126 is shaped and sized such that the distance d2 is less than or equal to the distance d1. Additionally, in one embodiment, the die 126 is a 6 ton die, e.g., a die rated to deliver six tons of pressure during a crimping process, etc. Other dies, e.g., a 12 ton die, etc., have outer surfaces without cutout portions that are sized and shaped differently than the die 126, e.g., with distances d2 greater than the distance d1. Thus, the shape, configuration, size, and spacing of the lips 214 and 216 may prevent insertion of another die, such as a 12 ton die, into the jaw mouth 208.

Figure 7A:
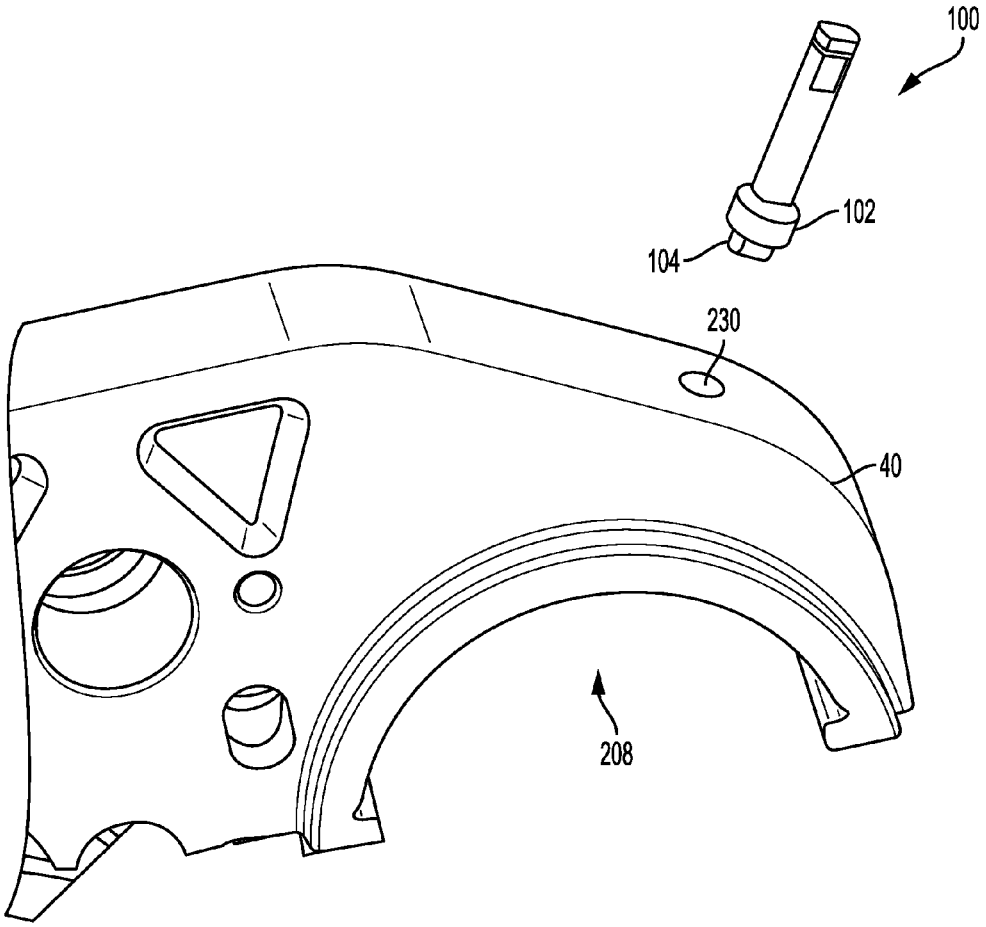
FIG. 7A illustrates a perspective view of a portion of the first crimping jaw illustrated in 6.
Figure 7B:
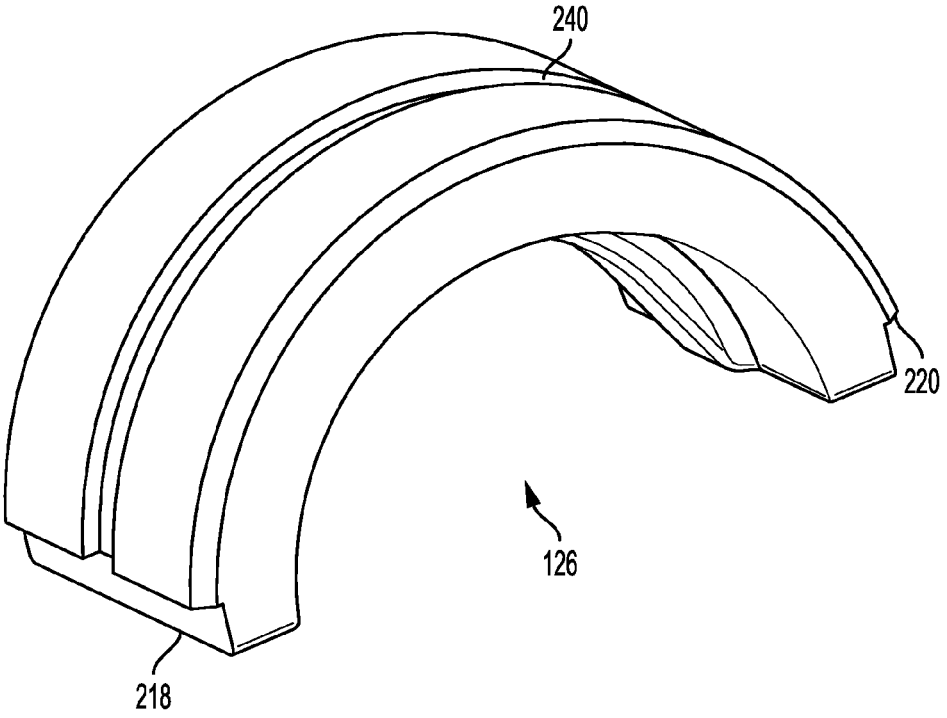
FIG. 7B illustrates a perspective view of a first die that can be inserted into the first crimping jaw illustrated in FIG. 7A.

For example, and returning to FIGS. 2-4, the crimping head further comprises two release tabs 112, 118 that are provided near an upper head portion of each crimping jaw 40, 44. These release tabs 112, 118 are provided so as to releasably engage a front edge of the crimping jaw. By removing these release tabs 112, 118, access to the first and second die pins 100, 106 may be provided. Each crimping jaw 40, 44 comprises a die pin bore that extends through the upper head portion of the jaw. For example, FIG. 7A provides a close up of view of a portion of the first crimping jaw 40, the first die pin bore 230 and the first die pin 100. As illustrated, the first die pin 100 can be removably inserted into this bore 230 through the inside mouth 208 of the crimping jaw 40. Preferably, the die pin 100 includes an enlarged circular head portion 102 and a rectangular protrusion 104 provided at an end of the head portion 102. Once the die pin 100 has been completely inserted into the pin bore 230 through the mouth 208 of the crimping jaw 40, it is this rectangular protrusion 104 of the die pin 100 that engages an external groove or track that is provided along an outer surface of the die. For example, FIG. 7B illustrates this external groove or track provided along an outer surface of the first die 126. Engagement of this rectangular protrusion 104 of the die pin 100 and the external track 240 of the die that prevents the die from sliding out of the jaw opening. A spring and retaining washer may be used to secure the die pin 100 in place.

Figure 8:
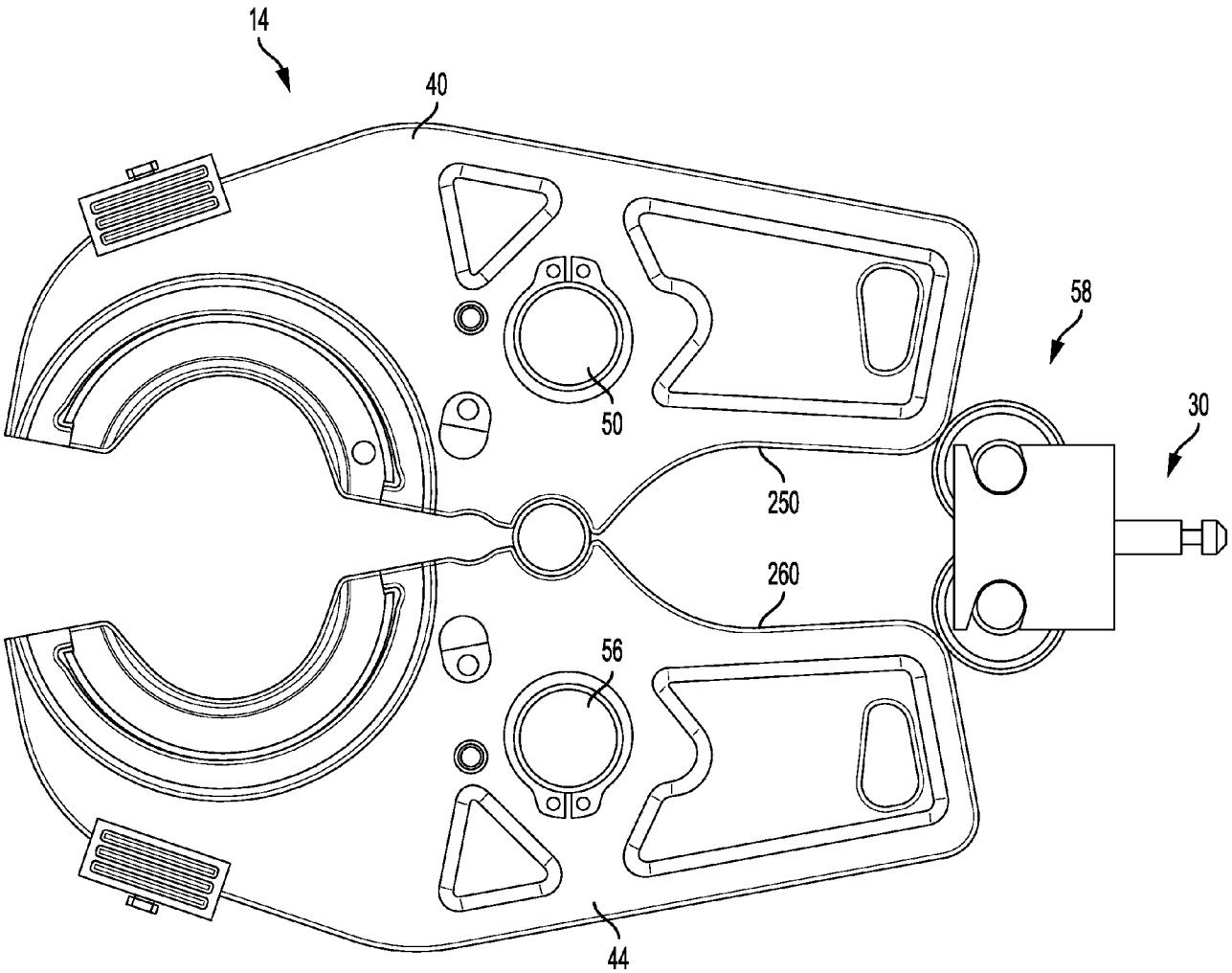
FIG. 8 illustrates a perspective view of the rollers of the hydraulic tool illustrated in FIG. 1 beginning to act upon the crimping head illustrated in FIGS. 1-2.

FIG. 8 illustrates a perspective view of the rollers of the hydraulic tool 10 illustrated in FIG. 1 beginning to acting upon the crimping head 14 so as to perform a crimp. For ease of explanation, the side plates of the crimping head have been removed. Specifically, FIG. 8 illustrates the crimping head 14 in an open position. In this open position, pivoting the first and second crimping jaws 40, 44 about their respective pivoting pins 50, 56, stresses or strains the extension spring that is operatively coupled to the first jaw and the second jaw as discussed herein. As such, the crimping head 14 comprises a first pivoting pin 50 and a first crimping jaw 40 disposed for rotation about a first axis defined by the first pivoting pin 50. The crimping head 14 further comprises a second pivoting pin 56 and a second crimping jaw 44 disposed for rotation about a second axis defined by the second pivoting pin 56.

Figure 9:
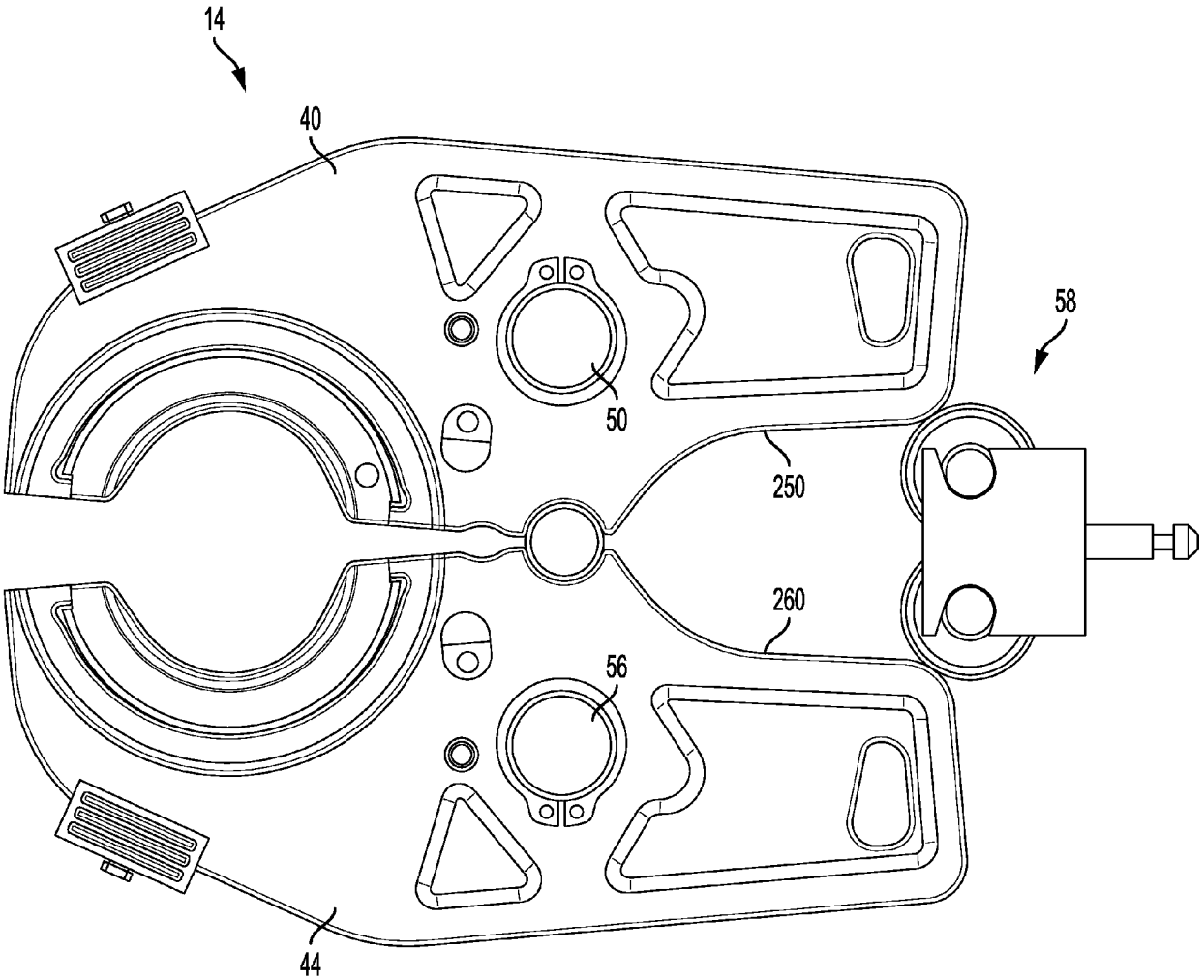
FIG. 9 illustrates another perspective view of the rollers of the hydraulic tool illustrated in FIG. 1 continuing to act on the crimping head.
Figure 10:
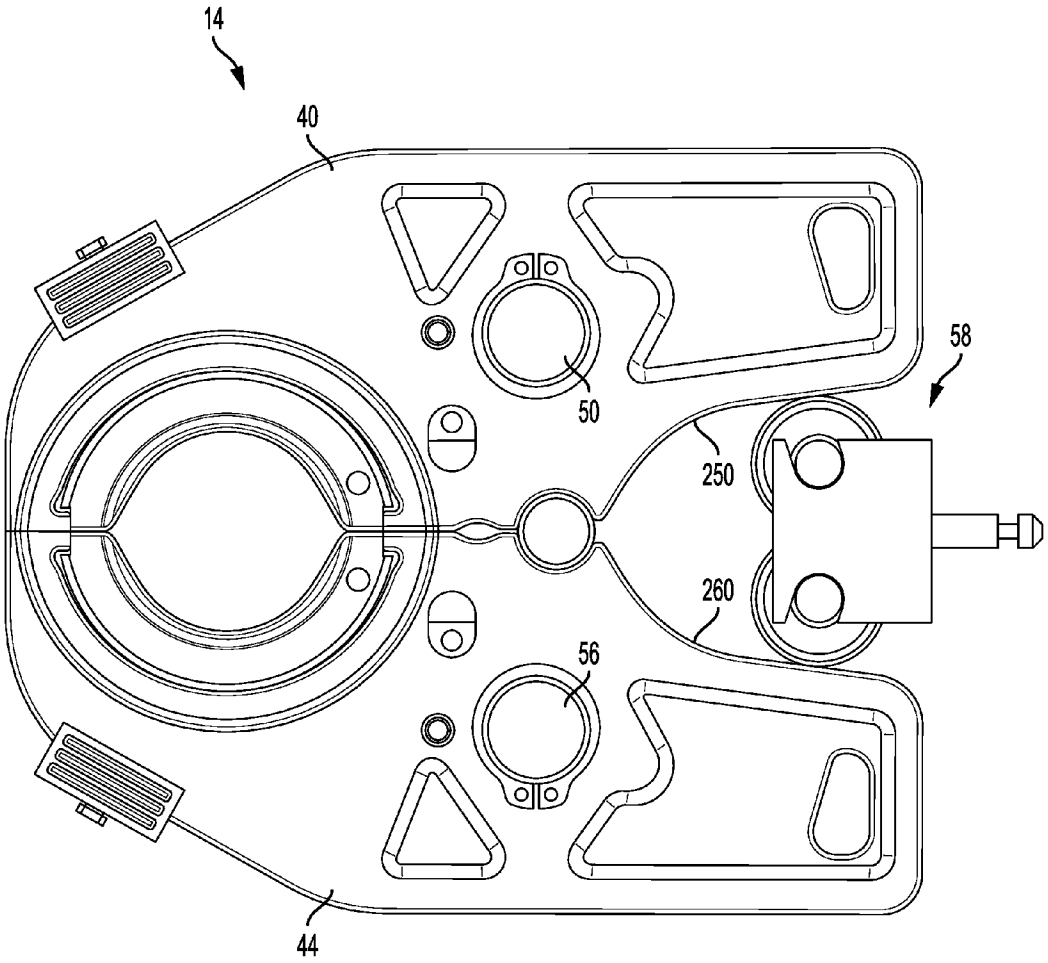
FIG. 10 illustrates yet another perspective view of the rollers of the hydraulic tool illustrated in FIG. 1 continuing to act on the crimping head.

In operation, and as illustrated in FIG. 9, the piston 30, see FIG. 1, moves a set of rollers 58 towards the crimping head 14. As the set of rollers 58 begins to enter a pivoting jaw cavity defined by the first and second jaws, the set of rollers bear against respective inner cam surfaces 250, 260 of the pivoting jaws. For example, FIG. 8 illustrates another perspective view of the rollers 58 of the hydraulic tool 10 illustrated in FIG. 1 acting on the crimping head 14 wherein the jaws begin to pivot about their respective pivoting pins 50, 56. During this illustrated crimping action, the first crimping jaw rotates about a first axis defined by the first pivoting pin 50, and the second jaw rotates about a second axis defined by the second pivoting pin 56. And finally, FIG. 10 illustrates yet another perspective view of the rollers 58 of the hydraulic tool 10 illustrated in FIG. 1 acting on the crimping head 14 wherein the crimping jaws reside in a final crimp position.

The presently disclosed biased closed, dual pivoting crimping head provides a number of advantages over known hydraulic crimping tools. For example, one advantage of the presently know crimping tool is that alignment is easier because of the spring biased closed nature of the crimping head. Another advantage is that the dual pivoting crimping head also reduces the amount of warpage that may be produced by single pivoting crimping heads. It has been shown that the dual pivoting, biased closed crimping head allows the jaws to sweep a lower arc and therefore achieve a crimp that allows the device to crimp more evenly from an inside to an outside of a connector than single pivoting crimping heads.

Another advantage is that, because of the biased open state of the crimping head, the presently disclosed crimping head is easier for a single person to operate the crimping tool than other known hydraulic crimping tools. Rather than having to jog a biased open crimping head to a partially closed position, a user of the presently disclosed biased closed crimping head can now place the crimping jaws directly on the targeted crimp location and the extension spring within the crimping head will maintain the jaws along a surface of the connector prior to operating the device, thereby helping to ensure that the user achieves a higher quality crimp at a desired location.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

We claim:

1. A biased closed crimping head for a hydraulic power tool, the crimping head comprising:

a first pivoting pin;

a first jaw disposed for rotation about a first axis defined by the first pivoting pin, a first die pin bore extending through an upper head portion of the first jaw;

a second pivoting pin;

a second jaw disposed for rotation about a second axis defined by the second pivoting pin, a second die pin bore extending through an upper head portion of the second jaw; and an extension spring configured to bias the jaws toward closed position, wherein during a crimping action, the first jaw rotates about the first axis defined by the first pivoting pin, and the second jaw rotates about the second axis defined by the second pivoting pin.

2. The biased closed crimping head of claim 1, further comprising:

a first side plate mounted on a first side of the first jaw and the second jaw, wherein the first side plate is configured to hold the first jaw and the second jaw together, and wherein the first side plate has a first bore configured to receive the first pivoting pin and a second bore configured to receive the second pivoting pin; and a second side plate mounted on a second side of the first jaw and the second jaw opposite the first side plate, wherein the second side plate is configured to hold the first jaw and the second jaw together, and wherein the second side plate has a third bore configured to receive the first pivoting pin and a fourth bore configured to receive the second pivoting pin.

3. The biased closed crimping head of claim 2, further comprising:

a first stop pin mounted adjacent to the first pivoting pin in a bore defined in the first jaw, wherein the first side plate comprises a first curved keyway configured to receive the first stop pin, and wherein the second side plate comprises a second curved keyway opposite the first curved keyway of the first side plate and configured to receive the first stop pin; and a second stop pin mounted adjacent to the second pivoting pin in a respective bore defined in the second jaw, wherein the first side plate comprises a third curved keyway configured to receive the second stop pin, and wherein the second side plate comprises a fourth curved keyway opposite the third curved keyway of the first side plate and configured to receive the second stop pin.

4. The biased closed crimping head of claim 2, wherein the first jaw and the second jaw define a pivoting jaw cavity therebetween, wherein the pivoting jaw cavity is configured to receive a roller assembly coupled to a piston of the hydraulic power tool, wherein the first side plate comprises a first clearance chamfer provided along a side surface of the first side plate and configured to allow for insertion of a first roller of the roller assembly into the pivoting jaw cavity during the crimping action, and wherein the second side plate comprises a second clearance chamfer provided along a respective side surface of the second side plate and configured to allow for insertion of a second roller of the roller assembly into the pivoting jaw cavity during the crimping action.

5. The biased closed crimping head of claim 2, wherein the first side plate includes a first connecting bore, wherein the second side plate includes a second connecting bore opposite the first connecting bore, and wherein the biased closed crimping head further comprises:

a sliding pin inserted through the first connecting bore and the second connecting bore, wherein the sliding pin is axially movable within the first connecting bore and the second connecting bore and extends outward from the first side plate and the second side plate to facilitate coupling the biased closed crimping head to the hydraulic power tool.

6. The biased closed crimping head of claim 2, further comprising:

plurality of retaining pins mounted about both ends of the first pivoting pin and both ends of the second pivoting pin, wherein the plurality of retaining pins are configured to secure the first side plate to the first jaw and the second jaw and secure the second side plate to the first jaw and the second jaw.

7. The biased closed crimping head of claim 1, wherein the first jaw includes a first dowel recess on a contour of the first jaw, wherein the second jaw includes a second dowel recess on a respective contour of the second jaw such that the first dowel recess and the second dowel recess form a bore between the first jaw and the second jaw, and wherein the biased closed crimping head further comprises a translation pin disposed in the bore formed by the first dowel recess and the second dowel recess.

8. The biased closed crimping head of claim 1, wherein a portion of a contour of the first jaw is shaped as an arc and configured as a first die mount, wherein a respective portion of a respective contour of the second jaw is shaped as a respective arc and configured as a second die mount, and wherein the biased close crimping head further comprises:

a first die removably secured within the first die mount; and a second die removably secured within the second die mount.

9. The biased closed crimping head of claim 8, further comprising:

a first die pin disposed in the first die pin bore extending through the upper head portion of the first jaw from an outer surface of the first jaw to the first die mount, wherein the first die pin is configured to secure the first die to the first die mount; and a second die pin disposed in the second die pin bore extending through the upper head portion of the second jaw from a respective outer surface of the second jaw to the second die mount, wherein the second die pin is configured to secure the second die to the second die mount.

10. The biased closed crimping head of claim 9, wherein the first die pin comprises a rectangular protrusion provided at an end of the first die pin, wherein the first die includes an external groove provided along an outer surface of the first die such that the rectangular protrusion of the first die pin engages the external groove of the first die to secure the first die within the first die mount.

11. The biased closed crimping head of claim 10, wherein the first die pin comprises an enlarged circular head portion disposed between the rectangular protrusion and a remaining portion of the first die pin, wherein the enlarged circular head potion rests against the first die mount when the first die pin secures the first die within the first die mount.

12. The biased closed crimping head of claim 10, further comprising:

a spring mounted around the remaining portion of the first die pin.

13. The biased closed crimping head of claim 9, further comprising:

a release tab mounted to the upper head portion of the first jaw and configured to secure an end of the first die pin at the outer surface of the first jaw.

14. The biased closed crimping head of claim 1, wherein the first jaw and the second jaw define a pivoting jaw cavity therebetween, wherein the pivoting jaw cavity is bounded by a first cam surface of the first jaw and a second cam surface of the second jaw such that the pivoting jaw cavity is configured to receive a roller assembly coupled to a piston of the hydraulic power tool, wherein the roller assembly includes (i) a first roller configured to track the first cam surface when the piston pushes the roller assembly inside the pivoting jaw cavity during the crimping action, and (ii) a second roller configured to track the second cam surface when the piston pushes the roller assembly inside the pivoting jaw cavity during the crimping action.

15. A biased closed crimping head for a hydraulic power tool, the crimping head comprising:

a first pivoting pin;

a first jaw disposed for rotation about a first axis defined by the first pivoting pin, wherein a portion of a contour of the first jaw is shaped as an arc and configured as a first die mount;

a second pivoting pin;

a second jaw disposed for rotation about a second axis defined by the second pivoting pin, wherein a respective portion of a respective contour of the second jaw is shaped as a respective arc and configured as a second die mount;

a first die removably secured within the first die mount;

a second die removably secured within the second die mount; and an extension spring configured to bias the jaws toward closed position, wherein during a crimping action, the first jaw rotates about the first axis defined by the first pivoting pin, and the second jaw rotates about the second axis defined by the second pivoting pin.

16. The biased closed crimping head of claim 15, wherein the first die and the second die are made of stainless steel.

17. The biased closed crimping head of claim 15, wherein a distance between a first end and a second end of the arc of the first jaw is less than a distance selected from the group consisting of (i) 40 millimeter (mm), (ii) 39.8 mm, and (iii) 39.6 mm.

18. A biased closed crimping head for a hydraulic power tool, the crimping head comprising:

a first pivoting pin;

a first jaw disposed for rotation about a first axis defined by the first pivoting pin, wherein a portion of a contour of the first jaw is shaped as an arc and configured as a first die mount;

a second pivoting pin;

a second jaw disposed for rotation about a second axis defined by the second pivoting pin, wherein a respective portion of a respective contour of the second jaw is shaped as a respective arc and configured as a second die mount;

a first die;

a first die pin disposed in a first die pin bore extending through an upper head portion of the first jaw from an outer surface of the first jaw to the first die mount, wherein the first die pin comprises a rectangular protrusion provided at an end of the first die pin, and wherein the first die includes an external groove provided along an outer surface of the first die such that the rectangular protrusion of the first die pin engages the external groove of the first die to removably secure the first die within the first die mount;

a second die;

a second die pin disposed in a second die pin bore extending through a respective upper head portion of the second jaw from a respective outer surface of the second jaw to the second die mount, wherein the second die pin comprises a respective rectangular protrusion provided at an end of the second die pin, and wherein the second die includes a respective external groove provided along a respective outer surface of the second die such that the respective rectangular protrusion of the second die pin engages the respective external groove of the second die to removably secure the second die within the second die mount; and an extension spring configured to bias the jaws toward closed position, wherein during a crimping action, the first jaw rotates about the first axis defined by the first pivoting pin, and the second jaw rotates about the second axis defined by the second pivoting pin.

19. The biased closed crimping head of claim 18, further comprising:

a first release tab mounted to the upper head portion of the first jaw and configured to secure an end of the first die pin at the outer surface of the first jaw; and a second release tab mounted to the respective upper head portion of the second jaw and configured to secure an end of the second die pin at the respective outer surface of the second jaw.

20. The biased closed crimping head of claim 18, wherein the first die and the second die are made of stainless steel.

* * * * *